US005145187A

United States Patent [19]

Lewis

[11] Patent Number: 5,145,187

[45] Date of Patent: Sep. 8, 1992

[54] LIGHT WEIGHT STABILIZED BROADHEAD ARROWHEAD WITH REPLACEABLE BLADES

[76] Inventor: Roger D. Lewis, 1019 County Hwy. AA, Nekoosa, Wis. 54457

[21] Appl. No.: 837,851

[22] Filed: Feb. 18, 1992

[51] Int. Cl.[5] ..... F42B 6/08

[52] U.S. Cl. ..... 273/422

[58] Field of Search ..... 273/419–422

[56] References Cited

U.S. PATENT DOCUMENTS

| | | | |
|---|---|---|---|
| D. 236,465 | 8/1975 | Hamilton | 273/421 X |
| 2,686,055 | 8/1954 | Peltz | 273/419 X |
| 2,836,930 | 6/1958 | Ragazzo et al. | 273/419 X |
| 2,940,758 | 6/1960 | Richter | 273/419 X |
| 3,340,642 | 9/1967 | Vasiljevic | 273/419 X |
| 3,618,948 | 11/1971 | McGlocklin | 273/422 X |
| 3,746,334 | 7/1973 | Stubblefield . | |
| 3,910,579 | 10/1975 | Sprandel | 273/421 X |
| 4,381,866 | 5/1983 | Simo | 273/422 |
| 4,505,482 | 3/1985 | Martin, Sr. | 273/421 |
| 4,529,208 | 7/1985 | Simo | 273/422 |
| 4,676,512 | 6/1987 | Simo | 273/422 |
| 4,729,320 | 3/1988 | Whitten, III | 273/422 X |
| 4,772,029 | 9/1988 | Watkins | 273/416 |

*Primary Examiner*—Paul E. Shapiro
*Attorney, Agent, or Firm*—Foley & Lardner

[57] ABSTRACT

A broadhead arrowhead of the type having replaceable blades is formed with a central body which has slots which receive the replaceable blades and plural sets of holes formed radially therethrough to give the arrowhead significantly reduced weight compared to arrowheads of similar size, while retaining high strength and rigidity. Each set of holes is formed as a line of holes extending lengthwise along the central body, with the size of the holes from the back to the front of the body preferably decreasing in size to match the taper of the cross-sectional diameter of the central body. Where three blades are provided, six sets of holes may be formed in the central body by drilling through the central body, with the slots for admitting the blades extending through three of the sets of holes. In addition to reducing weight, the holes also provide a wind foil which is effective to reduce the noise of the arrow in flight and to improve its stability.

8 Claims, 2 Drawing Sheets

LIGHT WEIGHT STABILIZED BROADHEAD ARROWHEAD WITH REPLACEABLE BLADES

FIELD OF THE INVENTION

This invention pertains generally to the field of archery and particularly to arrowheads of the type having removable blades.

BACKGROUND OF THE INVENTION

Broadhead arrowheads having removable blades are well known and are commonly used in modern archery, particularly for arrows intended for hunting. Examples of broadhead arrowheads having replaceable blades are shown in the Peltz U.S. Pat. No. 2,686,055; Richter U.S. Pat. No.2,940,758; McGlocklin U.S. Pat. No. 3,618,948; Simo U.S. Pat. No. 4,381,866; Simo U.S. Pat. No. 4,529,208; Simo U.S. Pat. No. 4,676,512; and Whitten III U.S. Pat. No. 4,729,320.

Broadhead arrowheads generally are relatively heavy compared to an arrowhead without blades, which is particularly the case for a triple bladed broadhead. In general, the greater the weight on the tip of the arrow, the more difficult it is to control the flight of the arrow. Broadheads having replaceable blades are generally as heavy, if not heavier, than single piece broadheads because of the connector components required. Moreover, a broadhead is more inherently prone to deflection in the wind during flight than an arrow head without blades or flutes.

Consequently, to reduce the weight of the broadhead and to reduce the effect of wind resistance, typical designs for broadheads have a relatively short blade and body and a relatively steep angle on the blade. Because the effectiveness of broadheads in killing game animals is related to the total span from blade to blade (many state laws require a one inch cutting diameter around the periphery of the widest portion of the blades), shortening up the length of the arrowhead necessarily requires that the angle of the blade be steepened. However, a steeper angle broadhead will generally penetrate less readily than an arrowhead having low angle blades, and penetration loss is particularly evident when the arrowhead deflects off of bone, causing bending of the arrow shaft and loss of penetrating power, a problem which is aggravated for steeper angle blades.

SUMMARY OF THE INVENTION

In accordance with the present invention, a broadhead arrowhead having replaceable blades is formed with a central body, preferably tapered from back to front, a penetrating tip attached to the front of the body, and means on the back for attaching the body to an arrow shaft. Slots in the periphery of the body accept the replaceable blades, which are preferably long and have a relatively shallow angle to allow excellent penetration and minimization of deflection of the arrowhead off of bone. To maintain a low overall weight for the arrowhead, the central body has sets of holes formed therethrough in symmetrical arrangement to reduce the overall mass of the body without substantially affecting either its strength or rigidity. The holes are preferably formed as a plurality of sets of holes, each set having several holes in linear relation extending axially along the body, with the holes decreasing in size from the back to the front of the body generally in relation to the tapering of the body. In this manner, the solid material of the central body, for example high strength aircraft aluminum, is of relatively constant thickness at all points between the holes down the length of the central body.

For a triple blade broadhead, a series of six sets of holes is preferably formed in the body, with each linear set of holes equally spaced from the others. The slots which accept the replaceable blades are referably formed through the center of a set of holes, and the slots are preferably formed symmetrically about the periphery of the central body.

In the preferred construction, the central body is formed from a solid piece of high strength metal through which the holes are drilled. Each hole at a particular elevation along the length of the central body in each set of holes is preferably at the same longitudinal position, so that the sets of holes meet in the center. However, between each group of holes along the length of the body, a solid wall of metal is left which provides structural strength for the arrowhead. In addition to enabling the arrowhead of the present invention to be formed at a lower weight than would otherwise be the case for an arrowhead of the same size, the holes also can provide some reduction in wind resistance and a wind foil-type effect in flight, stabilizing the flight of the arrow and reducing the noise of the arrow. The holes in the central body also are found to provide somewhat more uneven cutting of tissue in a game animal upon penetration, resulting in faster hemorrhaging.

Further objects, features and advantages of the invention will be apparent from the following detailed description when taken in conjunction with the accompanying drawings.

DETAILED DESCRIPTION OF THE INVENTION

Figure 1:
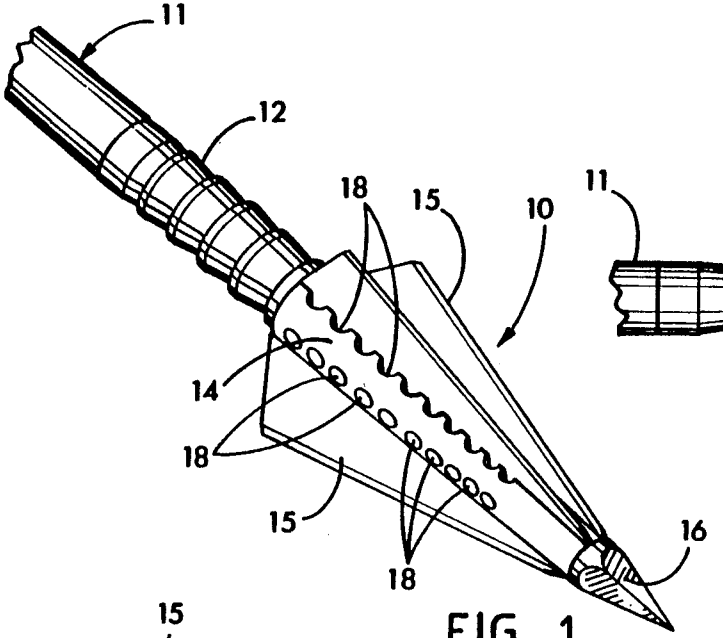
FIG. 1 is an illustrative perspective view of a broadhead arrowhead in accordance with the present invention.
Figure 5:
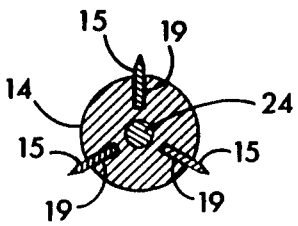
FIG. 5 is a cross-sectional view of the arrowhead taken generally along the lines 5—5 of FIG. 2.

With reference to the drawings, a perspective view of a broadhead arrowhead in accordance with the present invention is shown generally at 10 in FIG. 1 mounted at the end of an arrow shaft 11 by a connector 12. The broadhead 10 has a central body or ferrule 14, preferably of generally circular cross-section, which tapers from the back, at which the arrowhead is connected to the arrow shaft 11, to the front, a plurality (e.g., 3) preferably replaceable flutes or blades 15, and a sharp chisel point tip 16. The replaceable blades 15 may be formed in a conventional fashion and fit into slots 19 extending lengthwise (i.e., axially) along the surface of the body 14. The blades 15 are held in place in the slots 19 between the end of the connector 12 of the arrow shaft 11 and the tips 16 in a conventional fashion.

Figure 2:
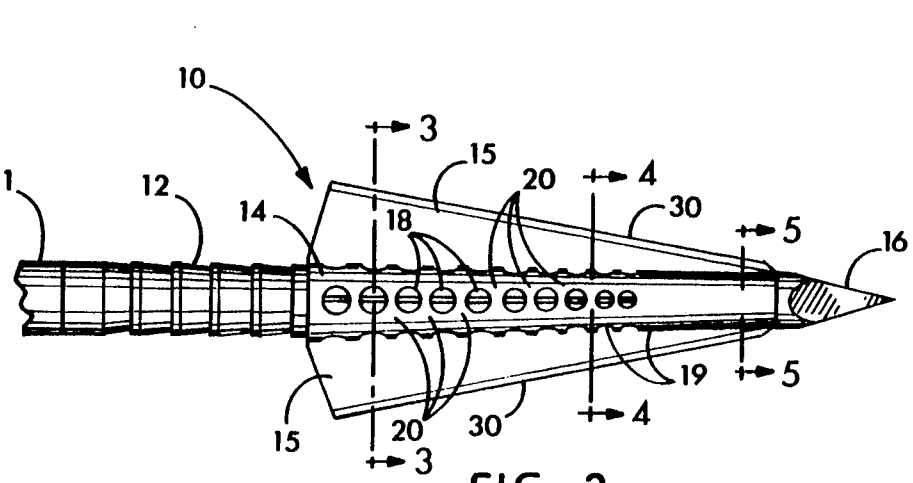
FIG. 2 is an elevational view of the arrowhead of FIG. 1.
Figure 4:
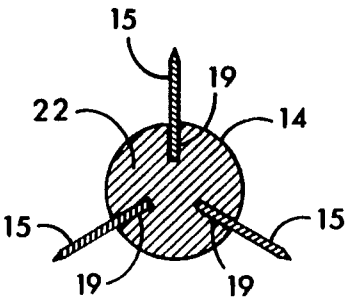
FIG. 4 is a cross-sectional view through the arrowhead taken generally along the lines 4—4 of FIG. 2.
Figure 3:
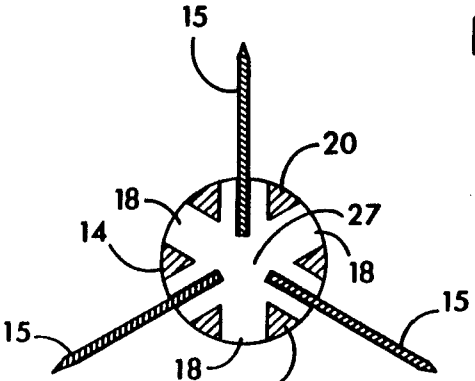
FIG. 3 is a cross-sectional view through the arrowhead taken generally along the lines 3—3 of FIG. 2.

The central body 14 is preferably formed of a strong, lightweight metal, such as aircraft aluminum. In accordance with the present invention, a plurality of sets of holes 18 are formed into the central body 14, preferably by drilling the holes radially completely through the body, and through the central axis of the body, to the other side. As best shown in the views of FIGS. 2 and 3, at each level along the length of the body, the holes are preferably drilled at the same elevation, and intersect at a central portion 21 where the material of the central body is, in effect, removed or hollowed out. However, between each of the holes 18 on the same level a solid segment 20 of metal remains, and the segments 20 preferably extend completely along the length of the central body from the rear to the front, providing a continuous, strong, unitary metal structure that runs the length of the body between each of the linear set of holes 18. In the embodiment shown, there are effectively six sets of holes 18 formed by drilling radially through the circular central body from three equally spaced angles. The solid metal segments 20 are left between each set. Between the holes 18 at adjacent elevations along the length of the central body, a solid metal wall 22 is left, as shown in FIG. 4. These walls 22 between the holes 18 in each of the various sets at each elevation along the length of the central body cooperate with the segments 20 to provide a strong, durable, yet lightweight structure. Such a structure is much stronger than would be the case if the central body had a completely hollow interior which extended the length of the central body. The walls 22 separating the holes 18 are also shown in cross-section in FIG. 7, which illustrates the manner in which the slot 19 is formed through each of the walls 22 between the holes 18. Where three blades 15 are used, three slots 19 may be formed at equally spaced positions around the circular periphery of the central body 14 extending through and joining the holes 18 in three of the sets of holes. In such a construction, because the holes extend radially through the central body, the three sets of holes opposite to the sets of holes through which the slot 19 passes do not have a slot connecting them.

Figure 6:
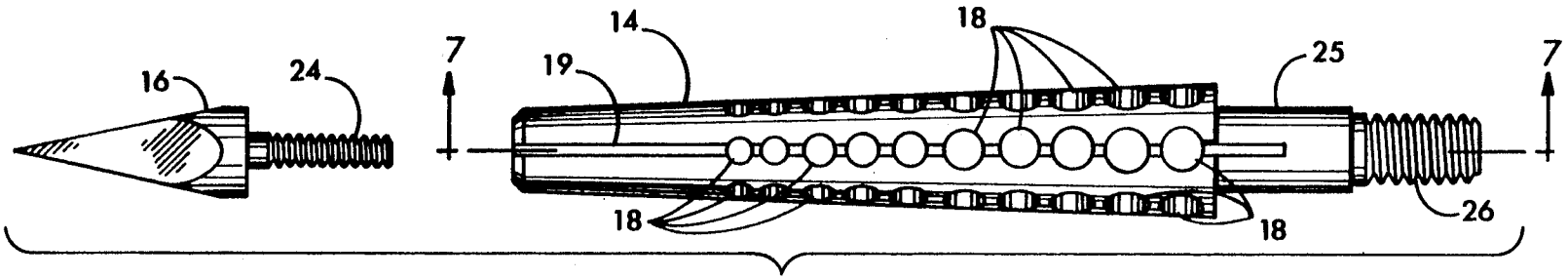
FIG. 6 is an elevational view of the central body of the arrowhead with the blades and the arrow shaft removed, and with the penetrating point shown adjacent thereto and in position to be assembled.
Figure 7:
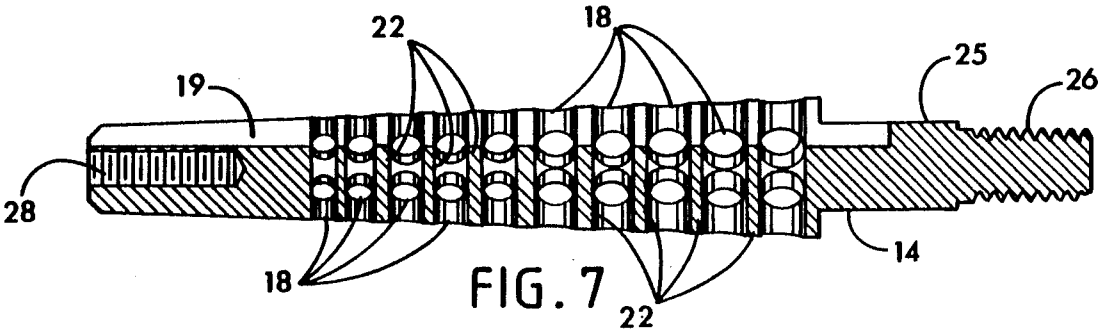
FIG. 7 is a cross-sectional view through the central body of FIG. 6 taken generally along the lines 7—7 of FIG. 6.
Figure 9:
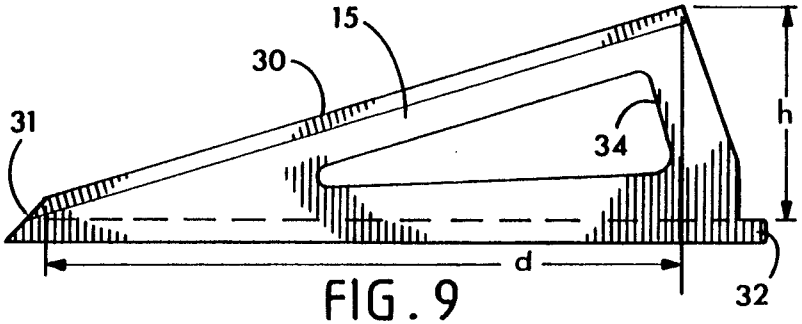
FIG. 9 is an elevational view of another replaceable blade that may be utilized in the arrowhead of the invention.
Figure 8:
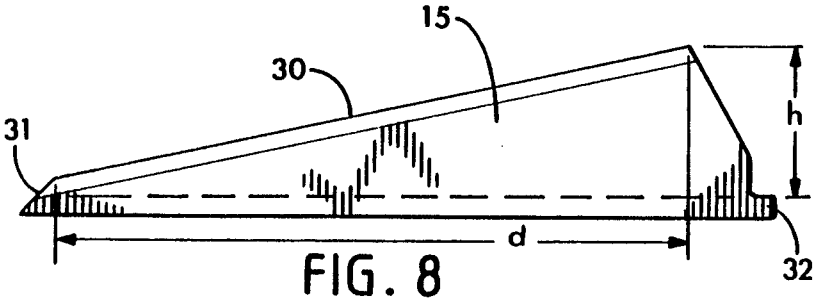
FIG. 8 is an elevational view of a typical replaceable blade that may be utilized in the arrowhead of the present invention.

As illustrated in FIGS. 6–8, the penetrating point 16, which may be a chisel point, may have a threaded shank 24 which threads into a bore 28 in the front end of the central body 14 in a conventional fashion to fit over and hold the front end 31 of the blades 15, while an arrow shaft connector (which may be integral with the arrow shaft) may thread over the shank 25 and the threaded extension 26 at the back of the central body 14 and fit over an extension 32 of the blade 15 to thereby hold the blade in place. As illustrated in FIG. 8, the blades 15 preferably have a sharpened cutting surface 30, formed similarly to a razor blade. The sharpened portion 30 of the blade will extend for length d along the central body and will extend a height h above the body. A typical length d of the blade in accordance with the present invention may be about 1.5 inches, and an exemplary height h of about 0.31 inch, and thus the blade has a relatively shallow angle of about 11 degrees. This relatively long length for the arrowhead and the relatively shallow angle provides good penetrating capability for the arrowhead and minimizes deflection. The aerodynamics of the arrowhead are also improved by having a relatively shallow angle on the blades. The blades may be, for example, 0.02 inch thick 60 Rockwell hard stainless blades. For the height of the blade noted above, approximately a $\frac{7}{8}$ inch cutting diameter is obtained. Other cutting diameters may, of course, be utilized, e.g. 1 and 5/16 inches. Where such a larger blade is used, as illustrated in FIG. 9, it is preferred that the blade 15 include a central opening 34 to reduce weight.

As best illustrated in FIGS. 2 and 6, the holes 18 in each set of holes preferably decrease in size from the back to the front of the central body to best accommodate the holes to the general taper from back to front of the central body. The decrease in the size of holes may be continuous or, as shown in FIGS. 2 and 6, may be staged with, e.g., the first four holes at the back being of the same size, the next three of a smaller size and the last two of an even smaller size. The purpose of decreasing the sizes of the holes is to have a substantially constant width of the segments 20 between the holes at each elevation level along the central body.

In addition to providing a very lightweight, yet strong and impact resistant central body structure, the formation of the holes in the manner described above also has other advantages. The central body retains a full sized circular periphery despite the holes, and therefore has a larger central shaft portion for penetration purposes than would a solid central body of comparable mass. Thus a full size but reduced weight broadhead is obtained. The holes also provide a wind foil effect during the flight of the arrow, providing stability to the arrow and reducing noise of the arrow in flight to give potential game less warning of the oncoming arrow. The placement of the holes in the central body also is found to result in a more uneven cutting of tissue as the arrowhead enters the game, resulting in more hemorrhaging and therefore quicker kill of the game animal.

The central body 14 can be made of various materials suited for arrowheads, such as stainless steel, aluminum and so forth. High strength aircraft aluminum is preferably utilized, and may be anodized with a coating on all inside and outside surfaces.

It is understood that the invention is not limited to the particular embodiments described herein as illustrative, but embraces such modified forms thereof as come within the scope of the following claims.

What is claimed is:

1. A lightweight broadhead arrowhead comprising:

a central body of substantially circular periphery having a front and a back, a plurality of slots formed in the periphery of the central body extending from the front to the back axially, and a plurality of sets of holes formed in the central body extending radially through the body, each set of holes comprising a plurality of holes extending in a line axially along the length of the central body, each line of holes in a set spaced from the line of holes in an adjacent set by solid segments of the central body, each hole in each set in the central body separated by solid metal of the body from the holes at the next higher or lower elevation to provide a solid metal wall through the cross-section of the central body between each of the holes at adjacent elevational levels;

a plurality of blades mounted in the slots in the central body;

a penetrating tip attached to the front end of the central body; and means on the back of the central body for attaching the body to an arrow shaft.

2. The broadhead arrowhead of claim 1 wherein the central body tapers in cross-section from the back to the front of the central body.

3. The broadhead arrowhead of claim 2 wherein the holes in each set decrease in size from the back to the front of the central body so as to maintain a substantially constant separation between the holes in different sets at each elevation level along the length of the central body.

4. The broadhead arrowhead of claim 1 wherein the central body is formed of high strength aluminum.

5. The broadhead arrowhead of claim 1 wherein the angle at which a cutting edge of each blade meets the central body is about 12 degrees or less.

6. The broadhead arrowhead of claim 1 wherein there are three slots in the central body equally spaced about the periphery of the body, and three blades mounted in the slots, and wherein there are six sets of holes, each set extending in a line along the length of the central body at equally spaced positions along the central body.

7. The broadhead arrowhead of claim 1 wherein the means for attaching an arrow shaft to the back of the central body comprises a shank extending rearwardly from the central body and having a threaded portion thereon which can be engaged and threaded into a similarly threaded bore in the end of an arrow shaft.

8. The broadhead arrowhead of claim 1 wherein the penetrating point has a threaded shank and the front end of the central body has a similarly threaded bore such that the shank of the penetrating tip can be threaded into the bore of the central body to connect the tip to the central body.

* * * * *